350-96.14 SR
8/19/86 XR 4,607,344

United States Patent [19]
Athale et al.

[11] Patent Number: 4,607,344
[45] Date of Patent: Aug. 19, 1986

[54] TRIPLE MATRIX PRODUCT OPTICAL PROCESSORS USING COMBINED TIME-AND-SPACE INTEGRATION

[75] Inventors: Ravindra A. Athale, Annandale, Va.; John N. Lee, Silver Spring, Md.

[73] Assignee: The United States of America as represented by the Secretary of the Navy, Washington, D.C.

[21] Appl. No.: 654,926

[22] Filed: Sep. 27, 1984

[51] Int. Cl.[4] ..... G06G 7/16
[52] U.S. Cl. ..... 364/841; 350/96.14; 350/162.12; 364/845; 364/822
[58] Field of Search ..... 364/819, 821, 822, 837, 364/841, 845, 713, 728, 754, 604, 606; 350/96.11, 96.13, 96.14, 162.12, 162.13, 162.14, 162.15

[56] References Cited

U.S. PATENT DOCUMENTS

| | | | |
|---|---|---|---|
| 3,305,669 | 2/1967 | Fan | 364/845 |
| 3,592,547 | 7/1971 | Noble | 364/822 X |
| 3,872,293 | 3/1975 | Green | 364/822 |
| 4,009,380 | 2/1977 | Bocker et al. | 364/822 |
| 4,286,328 | 8/1981 | Bocker | 364/822 X |
| 4,569,033 | 2/1986 | Collins et al. | 364/845 |

OTHER PUBLICATIONS

"Optical Matrix Algebraic Processors" discloses various optical matrix algebraic Processors, (Athale) Proc. of Tenth Int'L. Optical Computing Conference (1983), pp. 24–31, (IEEE Cat. No. 83, Ch 1880–1884).

*Primary Examiner*—Joseph Ruggiero
*Attorney, Agent, or Firm*—Robert F. Beers; Sol Sheinbein; William T. Ellis

[57] ABSTRACT

A triple matrix product processor for optically multiplying three matrices U. G, and V, comprising a matrix-vector processor for sequentially multiplying each column of an M×N matrix G by at least a row of a P×M matrix U so that the $1^{th}$ column of G is multiplied by the at least a row of matrix U producing at least the $il^{th}$ element of an intermediate result. The triple matrix product processor further includes an outer product processor for multiplying at least the $il^{th}$ element of the intermediate result with the $1^{th}$ row of an N×Q matrix V producing at least a row of an N×N outer product matrix in a first plane, and a time-integrating optical detector array for summing the light impinging on the first plane from the outer product processor to produce all or a portion of a P× triple matrix product after all of the N columns of the matrix G and all of the N rows of the matrix V have been cycled through the processors.

22 Claims, 7 Drawing Figures

OPTICS II

OPTICS I

TRIPLE MATRIX PRODUCT OPTICAL PROCESSORS USING COMBINED TIME-AND-SPACE INTEGRATION

BACKGROUND OF THE INVENTION

The present invention is directed to optical matrix multiplication, and more particularly, to the high speed matrix multiplication of three matrices.

The multiplication of three matrices is often encountered in problems involving the computation of singular values of matrices or involving orthogonal transformation of matrices. In this regard, see the reference by H. C. Andrews and C. L. Patterson, IEEE Trans. on Acoustics, Speech Signal Processing, Vol., ASSP 24, p. 26 (1976); W. K. Pratt, "Digital Image Processing," (John Wiley Publ.) 1978. For example, the computation of singular values of a co efficient matrix would be used to solve the least squares problem. Additionally, triple matrix processing could be used in image processing and transmission. For example, an orthogonal transformation, separable in row and column spaces applied to imagery (e.g., Fourier Transform) could be obtained by means of a triple matrix product. Also, the triple matrix product could be used in order to obtain bandwidth compression of high resolution images. Additionally. triple matrix multiplication could be used in the computation of orthogonal moments of an image for pattern recognition.

The triple matrix product operation is defined as $$a = \underline{U}\,\underline{G}\,\underline{V},$$

with $$a_{ij} = \sum_{k}^{N} U_{ik}\left(\sum_{l}^{N} G_{kl}V_{lj}\right)$$

$$= \sum_{l=1}^{N}\left(\sum_{k=1}^{N} U_{ik}G_{kl}\right) V_{lj},$$

where G is the input matrix which is left - and right -multiplied by the matrices U and V, respectively, producing the transformed matrix a. All of these matrices may be N×N square matrices for convenience. However, in the general case, each of the matrices have different dimensions, with the only requirement being that adJacent indices (the inner indices) for the matrices being multiplied be the same. This concept is illustrated as follows for the matrices U, G, and V:

$$\underset{\underline{U}}{P\times M} \cdot \underset{\underline{G}}{M\times N} \cdot \underset{\underline{V}}{N\times Q} = \underset{\underline{a}}{P\times Q}$$

It can be seen from the above that the inner matrix indices M for the matrices U and G match up, while the adjacent indices N for the matrices G and V also match up.

To illustrate a matrix of the type discussed, the G matrix containing M×N elements is represented below:

$$\begin{bmatrix} a_{11}\, a_{12}\, a_{13} \cdots a_{1N} \\ a_{21}\, a_{22}\, a_{23} \cdots a_{2N} \\ \cdot \\ \cdot \\ \cdot \\ a_{M1}\, a_{M2}\, a_{M3} \cdots a_{MN} \end{bmatrix}.$$

Similar representations are used for the matrices U and V.

A digital computer could be utilized in order to perform the above described triple matrix multiplication. However, the conventional serial digital processors require significant periods of time in order to effect such multiplications, particularly, for large matrices with dimensions on the order of 1000×1000. Optical techniques have been investigated for the purpose of matrix multiplication, since optics has the ability to perform many operations in parallel and thus would effect much faster matrix multiplication. In this regard, several optical processors have been developed for multiplying two matrices. See the article by R. A. Athale, "Optical Matrix Algebraic Processors: A Survey," Proceedings of the Tenth International Optical Computing Conference (1983), p. 24 (IEEE Cat. No. 83 Ch. 1880–4).

The triple matrix product operation typically is performed by first multiplying one matrix by a second matrix to obtain an intermediate result matrix, and then multiplying this intermediate result matrix by a third matrix. Although simple in principle, one of the main drawbacks of these two sequential multiplications, for either the digital or the optical approach, is that the intermediate result matrix produced by the first multiplication, e.g., U·G or G·V, must be stored and retrieved in the correct fashion. Thus, the required input-output interfacing between the two multiplication stages significantly slows the triple-matrix-product operation. For optical processors, additional input-output interfaces often reduce the dynamic range performance of the processors. Moreover, the sequential approach using the same two-matrix multiplier for both stages must always produce the full matrix answer since the intermediate result must be fully calculated. However, for a large number of practical applications only a few elements of the triple matrix product are needed. For example, in some applications only the diagonal elements, or the elements of a single row or a single column are required in order to obtain meaningful information. Accordingly, it is desirable, especially for optical processors with limited dynamic range, to apply their available optical power to the few matrix elements required, rather than generating the entire matrix.

OBJECTS OF THE INVENTION

Accordingly, it is an object of the present invention to perform high-speed matrix multiplication of three matrices.

It is a further obJect of the present invention to perform three matrix multiplication without storing an intermediate result.

It is yet a further obJect of the present invention to provide a triple matrix product processor design which may produce only a desired portion of the full triple matrix product.

It is a yet a further object of the present invention to perform the triple matrix product operation by performing only N sequential multiplication operations.

It is a still further object of the present invention to perform a triple matrix multiplication operation using time integration in order to obtain greater dynamic range than prior art devices.

Other objects, advantages, and novel features of the present invention will become apparent from the detailed description of the invention, which follows the summary.

SUMMARY OF THE INVENTION

Briefly, the above and other objects are achieved in a triple matrix product processor for optically multiplying three matrices U, G, and V, comprising a matrix-vector processor for sequentially multiplying each column of a $M \times N$ matrix G by at least a portion of a $P \times M$ matrix U, wherein at a given instant the $l^{th}$ column of G is multiplied by at least a portion of matrix U producing at least the $il^{th}$ element of an intermediate result. This device further includes an outer product processor for multiplying at least the $il^{th}$ element of the intermediate result with the $l^{th}$ row of a $N \times Q$ matrix V producing at least a portion of an $P \times Q$ outer product matrix in a first plane, and a time-integrating optical detector array for summing the light impinging on the first plane from the outer product processor to produce all or a desired portion of a $P \times Q$ triple matrix product after all of the N columns of the matrix G and all of the N rows of the matrix V have been cycled through the processors.

The matrix-vector processor and the outer product processor may be implemented in a variety of configurations. In a preferred embodiment, the matrix-vector processor may comprise a first spatial light modulator (SLM) for producing at least one row of the $P \times M$ matrix U thereon, with the P rows in the horizontal direction and the M columns in the vertical direction; means for illuminating this first SLM; a second $1 \times M$ one-dimensional spatial light modulator (SLM) disposed along one direction, e.g. horizontally, for sequentially producing the columns 1 to N of the $M \times N$ matrix G thereon, wherein at a given instant the $l^{th}$ column is reproduced thereon; first focusing means for focusing light from the first SLM to impinge on the second SLM; second focusing means for focusing light from the second SLM to a second focusing plane; and a spatial light filter disposed in the second focusing plane for averaging the light from the second SLM. The outer product processor may comprise a third one-dimensional spatial light modulator (SLM) disposed parallel to the first SLM, e.g. horizontally, for sequentially producing, in sequence with the first SLM, the rows to 1 to N of the $N \times Q$ matrix V, wherein at the given instant the $l^{th}$ row is reproduced thereon; third focusing means for focusing the averaged light from the spatial light filter onto the third SLM; and fourth focusing means for focusing light from the third SLM onto the optical detector array.

It should be noted that the location of the G matrix and the U matrix may be interchanged in this device. Likewise, it should be noted that the spatial light modulator for producing the matrix U may produce one row of that matrix if only a portion of the triple matrix product is desired, or it may produce the entire matrix U. Likewise, the time-integrating detector array may be configured to obtain only a portion of the $P \times Q$ triple matrix product, or it may detect the entire $P \times Q$ triple matrix product.

DETAILED DESCRIPTION OF THE PREFERRED EMBODIMENT

The present invention comprises a system for calculating the elements of the triple-product-matrix a using time and space integration, but without storing any intermediate results. This system is capable of modification in a simple fashion to calculate only a portion such as a diagonal or a row or column of a without losing computational efficiency. Additionally, a second system using time and space integration is described for calculating only a row or column of a.

Figure 1:
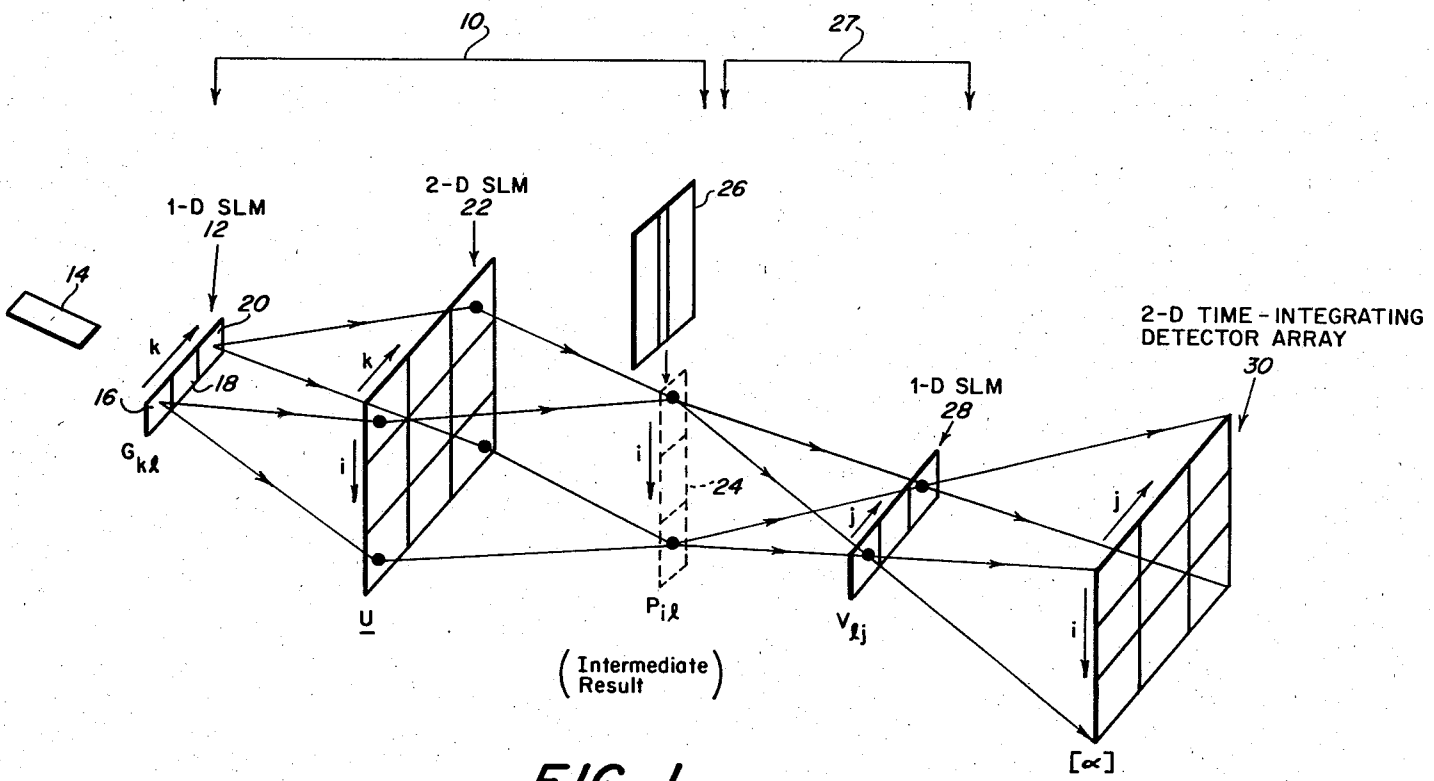
FIG. 1 is a schematic diagram of one embodiment of the present invention.

Referring now to the drawings wherein like reference numerals designate identical or corresponding parts throughout the several views, FIG. 1 is a schematic diagram of one embodiment of the present invention. For the sake of clarity all optical lens elements have been omitted from this figure. The first half of this processor is essentially a matrix-vector processor 10 for multiplying the $l^{th}$ column of G by the matrix U and producing the $l^{th}$ column of an intermediate result $P = U \cdot G$. For a more detailed discussion of matrix-vector processors, see the article by J. W. Goodman, A. R. Dias and L. M. Woody, Optics Letters, Vol. 2, page 1 (1978). The matrix-vector processor 10 comprises in this embodiment a first one-dimensional spatial light modulator (SLM) disposed along one direction e.g. horizontally, for sequentially producing the columns 1 to N of the $M \times N$ matrix G thereon, wherein at a given instant the $l^{th}$ column is produced thereon. In order to accommodate the matrix G, the one dimensional first SLM 12 should have M elements therein. This type of spatial light modulator may be implemented in a variety of configurations. The one dimensional SLM 12 may be implemented by an acousto-optic device driven by a transducer at one end thereof. There are a variety of other electro-optical devices which can also be used to implement the one-dimensional first SLM 12 of FIG. 1.

The above described types of spatial light modulators all require an external light source for illuminating the modulator. Such a source is represented in FIG. 1 by the numeral 14. It should be noted that this light source 14 may be either a coherent or an incoherent light source.

Alternatively, it should be noted that the one dimensional SLM 12 may be implemented by means of a one-dimensional light emitting diode array. In this instance, an external light source 14 would not be required.

In FIG. 1 the one-dimensional first SLM 12 is shown as having three individual spatial light modulating elements 16, 18 and 20. These individual elements 16, 18, and 20 of the first SLM 12 are modulated in opacity according to the values of a column of the matrix G. The light propagating from the light source 14 is modulated spatially in intensity by each of the elements 16, 18, 20 in accordance with a modulation value which is proportional to the respective column element in matrix G. For example, for the first element of the third column, i.e., $g_{13}$, the light is modulated in the element 20 by an amount proportional to that matrix element. As a result, the intensity of the light passing through this element 20 is made proportional to this matrix element $g_{13}$.

The matrix-vector processor 10 further comprises a second spatial light modulator 22 for producing at least a row of the P×M matrix U thereon, with the P rows in the horizontal direction and the M columns in the vertical direction. Again, for purposes of illustration the second SLM 22 is illustrated in FIG. 1 as a 3×3 matrix for a 3×3 matrix U. For purposes of discussion, it will be assumed that the entire matrix U is produced on the second SLM 22. Again, this spatial light modulator 22 may be implemented by electro-optical devices such as the Hughes liquid crystal valve, or the Litton magnetooptic modulator, or simply by a section of film. Each of the individual elements in the 3×3 second SLM 22 is given a degree of opacity in order to modulate the intensity of the light passing therethrough in accordance with corresponding element in the matrix U. Thus, in operation, the light propagating from the light source 14 is modulated by the $l^{th}$ column of G in the one dimensional first SLM 12, and then is modulated by the full matrix U in the second SLM 22 to yield the $l^{th}$ column of the intermediate result matrix P. The first element $P_{1l}$ in the intermediate result column is obtained by multiplying the first column of G by the first row of U. The second element in the intermediate result column, $P_{2l}$, is obtained by multiplying the first column of G by the second row of U. The other elements are generated in a similar fashion.

In order to realize the $l^{th}$ column of the intermediate result ($P=U \cdot G$), the light output from the second SLM 22 must be integrated. This integration may be effected by placing a lens in combination with a spatial light filter after the second SLM 22. The spatial light filter acts to average the light focused by the lens (not shown) in the lenses focal plane. The particular type of spatial light filter to be utilized depends on whether the light is coherent light or incoherent light. For coherent light, the spatial light filter could be implemented by a narrow slit or low pass spatial filter. For incoherent light, the spatial light filter could be implemented by a diffuser such as opal glass or ground glass. In FIG. 1, the $l^{th}$ column of the intermediate result is represented by the vertical one-dimensional three element array 24 shown in dashed lines. The spatial light filter is represented by the narrow slit 26, which would be located at the position of the dashed line array 24.

The triple matrix product processor further comprises an outer product processor 27 of the type described in the reference by R. A. Athale and W. C. Collins, Applied Optics, Vol 21, page 2089 (1982). The $l^{th}$ column of the intermediate result represented by the dashed line array 24 acts as the input to the outer product processor 27. The outer product processor 27 includes a third one-dimensional spatial light modulator (SLM) 28 which is disposed parallel to the first SLM 12, e.g. horizontally, for sequentially producing synchronously with the first SLM 12, the rows 1 to N of the N×Q matrix V, wherein at the given instant the $l^{th}$ row is reproduced thereon. Again, this third SLM 28 may be implemented by an electro-optical device or an acousto-optic device driven by a transducer disposed at one end thereof.

The P×Q outer product matrix resulting from the light being modulated by this third SLM 28 is summed in a two-dimensional time-integrating detector array 30 to produce the final matrix result a. Again, for convenience the P×Q matrix a is represented in FIG. 1 as a 3×3 matrix. After all of the N columns of the matrix G in conjunction with all of the N rows of the matrix V have been cycled through their respective SLM's, then the P×Q triple-matrix product is realized. Thus, it can be seen that only N iterations are required for this device and no intermediate result storage is required.

The above described processor requires one two-dimensional spatial light modulator to input the matrix U, two one-dimensional spatial light modulators to input a column of G and the corresponding row of V, respectively, and a two-dimensional time-integrating detector array to output the triple-matrix product a. Such a design has the advantage that the two-dimensional spatial light modulator containing the matrix U must be updated only after N cycles of the one-dimensional SLM's. Thus the framing rates for the one-dimensional SLM's are N times that for the two-dimensional SLM. This feature is important because the one-dimensional SLM's are capable of much faster frame rates than the two-dimensional SLM. Hence, the frame rate for this triple-matrix product processor is not limited by the slow frame rates of present-day two-dimensional SLM's, as are other optical matrix processors, since this two-dimensional SLM must only be updated after N cycles of the one-dimensional SLM's. It should be noted that this triple matrix processor has $N^2$ parallel channels.

From the above, it can be seen that the cumulative light intensity at a given location in the time-integrating detector array 30, after N cycles of the one-dimensional SLM's 12 and 28, will give the value of the corresponding element in the matrix a. If only a few elements of a are desired (e.g. along the diagonal, or a row or a column) then only those elements can be detected by suitably placed time-integrating detector arrays or single array elements.

It should be noted that it is also possible to add a space-variant holographic optic element at the detector 30 output to collect several different $a_{ij}$'s and focus them on a single detector for generating the sum of all of those elements. It should be noted however, that the number of cylces of the one dimensional SLM's 12 and 28 required to generate the final answer is independent of the number of elements of the triple matrix product a desired.

Figure 2:
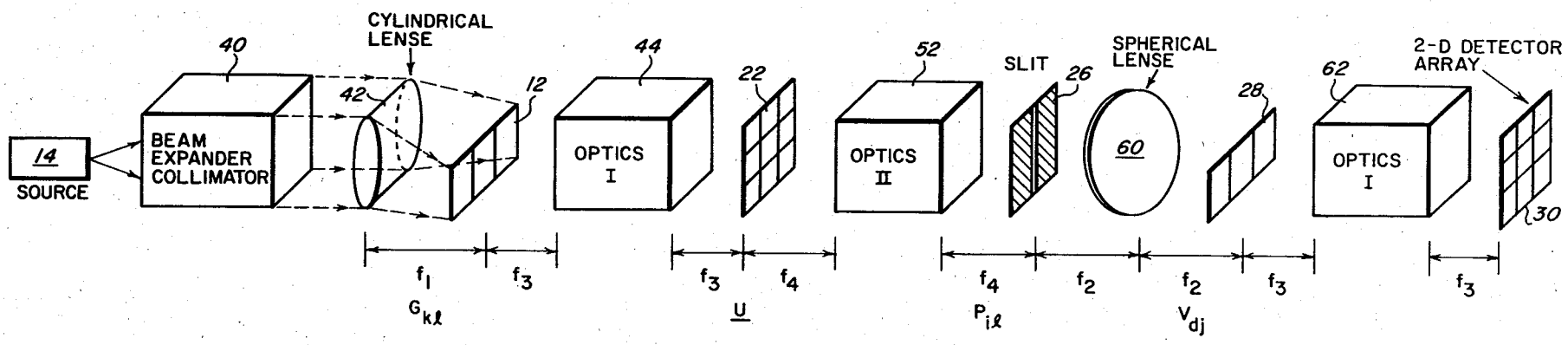
FIG. 2 is a schematic block diagram showing more details of the embodiment shown in FIG. 1.

As noted previously, the various focusing lens systems between the spatial light modulator elements were deleted from FIG. 1 for purposes of clarity. FIG. 2 represents these various lens focusing sytems. In particular, when an external light source 14 is utilized in order to illuminate the one-dimensional first SLM 12, then a lens system comprising a beam expander/collimator 40 in conjunction with a cyclindrial lens 42 may be utilized. The beam expander/collimator 40 may, for example, be implemented by the model LC 5 made by the Newport Corporation of California, and would operate to expand and collimate the light coming from the light source 14. The cylindral lens 42 would be disposed in the horizontal direction, as shown in FIG. 2, and would focus the light in the vertical direction in order to impinge on the one-dimensional first SLM 12.

The modulated light propagating from the one-dimensional first SLM 12 must then be focused on the two-dimensional second SLM 22. A lens focusing system designated by the block 44, titled Optics I, is disposed between the first SLM 12 and the second SLM 22 in order to effect this focusing. The function of this Optics I block 44 is to image the light from the first SLM 12 along the horizontal direction while Fourier transforming the light coming from the first SLM 12 in the vertical direction. The Fourier Transform operation on a light beam will have a different effect depending on whether the light beam approaching the Fourier Transform device is collimated or is spreading out. If the light approaching the Fourier Transform lens system is spreading out, then the Fourier Transform lens system operates to collimate the light. If the light propagating toward the Fourier Transform lens system is collimated, then the Fourier Transform lens system operates to focus the light.

Figure 3:
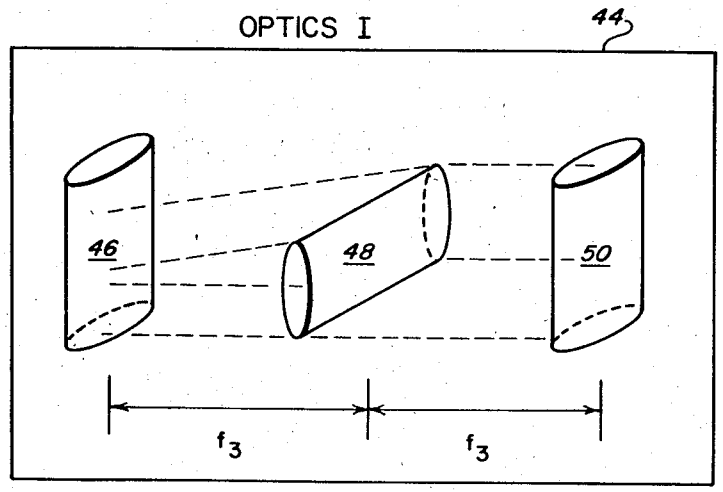
FIG. 3 is a schematic diagram of the lens configuration for the Optics I block shown in FIG. 2.

One embodiment of a lens system which may be utilized to implement the Optics I block is shown in FIG. 3. The Optics I block 44, in this embodiment, is shown to comprise a cyclindrial lens 46 disposed with its longitudinal length in the vertical direction relative to the direction of the one-dimensional first SLM 12. This cyclindrical lens 46 has a focal length of $f_3$. This vertical cyclindrical lens 46 is located a focal distance $f_3$ from the first SLM 12. A second cylindrical lens 48 is disposed parallel to the first SLM 12, e.g. horizontally, and is disposed at a distance of one focal length $f_3$ from the cylindrical lens 46. This horizontal cyclindrical lens 48 has a focal length of $2f_3$. Finally, another cylindrical lens 50 disposed perpendicular to the first SLM 12, e.g. vertically, and is disposed at a distance of focal length $f_3$ from the horizontal cyclindrical lens 48. This second vertical cyclindrical lens 50 again has a focal length of $f_3$. The two-dimensional second SLM 22 is disposed one focal length distance of $f_3$ from this second vertical cylindrical lens 50. In essence, Optics I operates to image along the horizontal direction while spreading and collimating the light in the vertical direction. The lenses 46 and 50 operate to image light in the horizontal direction, while the lens 48 collimates the light.

Figure 4:
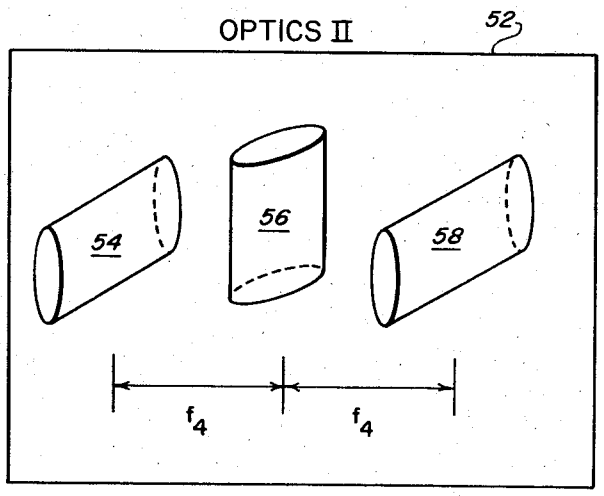
FIG. 4 is a schematic diagram showing the lens configuration for the Optics II block of FIG. 2

In order to obtain the intermediate result at the spatial light filter 26, a second optical lens system must be disposed between the second SLM 22 and the spatial light filter 26. This second lens system 52 is designated Optics II. One lens configuration which may be utilized to implement the Optics II block 52 is shown in FIG. 4. In this lens configuration, a first cyclindrical lens 54 is disposed in parallel with respect to the first SLM 12, e.g. horizontally. This horizontal cyclindrical lens 54 has a focal length of $f_4$ and is disposed at a focal distance of $f_4$ from the second SLM 22. Likewise, a second cylindrical lens 56 which is disposed perpendicularly with respect to the first SLM 12, e.g. vertically. This vertical cylindrical lens 56 is disposed at a focal distance of $f_4$ from the horizontal cylindrical lens 54, and it has a focal length of $2f_4$. Finally, a second cylindrical lens 58 is disposed in parallel with the first SLM 12, e.g. horizontally, and is disposed at a focal distance of $f_4$ from the vertical cylindrical lens 56. This second horizontal cylindrical lens 58 has a focal length of $f_4$. The spatial light filter 26 is disposed at a focal distance of $f_4$ from the second horizontal cylindrical lens 58. In Optics II, the lenses 54 and 58 image light in the vertical direction, while lens 56 focuses collimated light into the slit of the spatial light filter 26.

For further information on lense configurations of the type shown in Optics I and Optics II, see the reference "Space-Variant Processing of 1D Signals," by R. J. Marks, J. F. Walkup, M. 0. Hagler, T. F. Krile, Journal of Applied Optics, Vol. 16, p. 739 (1977).

The intermediate result from the spatial light filter 26 must then be focused onto the one-dimensional third SLM 28. The lens configuration used in order to accomplish this focusing operation may simply be a spherical lens 60. This spherical lens operates to perform a two-dimensional Fourier Transform on the light distribution from the spatial light filter 26. In essence, this spherical lens 60 focuses the light in the vertical direction out of the slit and collimates the light out of the slit in the horizontal direction. This spherical lens has a focal length of $f_2$ and is disposed at a focal length of $f_2$ distance from the spatial light filter 26. Likewise, the third SLM 28 is disposed at the focal distance $f_2$ from the spherical lens 60.

Finally, the modulated light output from the third SLM 28 must be focused onto the two-dimensional time-integrating detector array 30. This focusing may be simply accomplished by disposing a lens system similar to the lens system of the Optics I block 44 in between the third SLM 28 and the two-dimensional detector array 30. This Optics I block 62 again is disposed at a focal length of $f_3$ distance from the SLM 28. Likewise, the two-dimensional detector array 30 is disposed at a focal length distance of $f_3$ from the other end of the Optics I block 62. The Optics I block may be utilized in this situation because it is functioning to focus the light from a horizontal array, i.e., to expand the light in the vertical direction and image the light in the horizontal direction onto a two-dimensional array.

Figure 5:
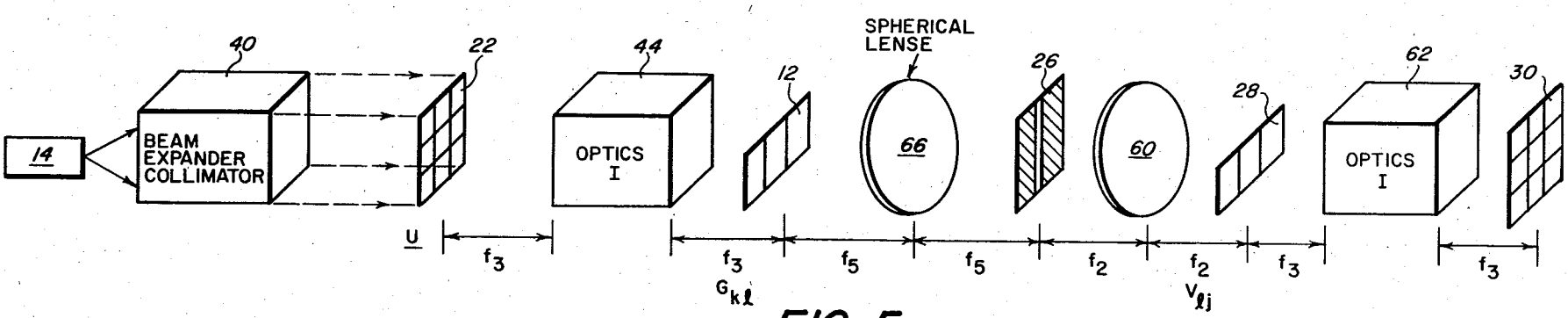
FIG. 5 is a schematic block diagram of a second embodiment of the present invention.

It should be noted that the triple matrix product of the matrices U, G, V may also be obtained using a configuration where the first and second SLM's are reversed. Such a confirguration is shown in FIG. 5. In this configuration, the two-dimensional SLM 22 is disposed immediately after the beam expander/collimater 40. There is no longer a need for the cylindrical lens 42 shown in FIG. 2. The Optics I block 44 is identical to the Optics I block 44 shown in FIG. 2. This Optics I block 44 again images the light in the horizontal direction and functions to Fourier transform the light in the vertical direction from the SLM 22 onto the one-dimensional SLM 12. The light modulated from the one-dimensional SLM 12 is focused onto the spatial light modulator 26 by means of a spherical lens 66. This spherical lens 66 operates to perform a two-dimensional Fourier transform on the light distribution from the SLM 12. In essence, lens 66 focuses the light in the horizontal direction and recollimates and images the light in the vertical direction.

After this spherical lens 66, the optical elements 26, 60, 28, 62, and 30 are identical to those same optical elements shown in FIG. 2.

From the above, it can be seen that this configuration of FIG. 5 is advantageous in that eliminates the cylindrical lens 42 and replaces the Optics II block 52 with a simple spherical lens 66.

Figure 6:
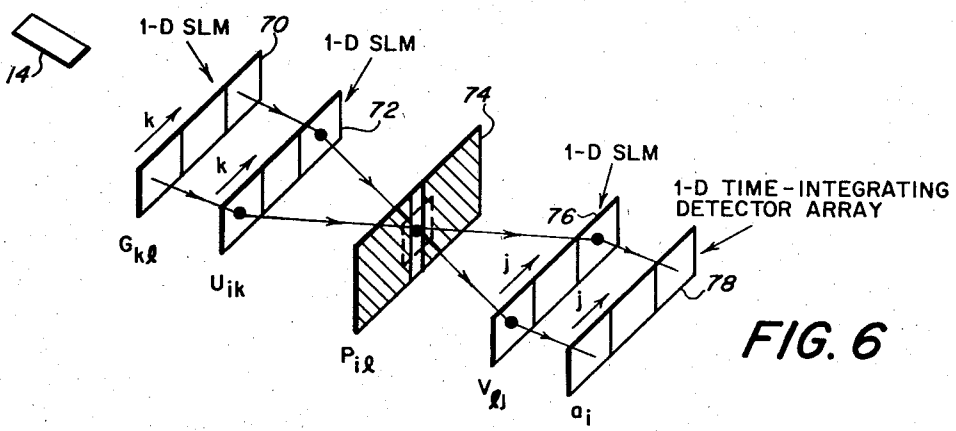
FIG. 6 is a schematic diagram of a third embodiment of the present invention for generating the $i^{th}$ row of the triple-matrix-product.

If the triple-matrix product application demands an evaluation of only a particular row or column of a, then the triple-matrix product processor can be simplified to consist only of one-dimensional spatial light modulators as shown in FIG. 6. The layout of this system is identical, whether a row or a column of a is desired. However, the data input to the one-dimensional SLM's will differ depending on whether a row or a column of a is desired. FIG. 6 depicts the data format required to generate a row of a. The first one-dimensional SLM 70 is again disposed along one direction, e.g. horizontally, for sequentially producing the columns 1−N of the M×N matrix G thereon, wherein at a given instant the $l^{th}$ column is reproduced thereon.

The second one-dimensional SLM 72 contains the $i^{th}$ row of U. The modulated light transmitted through both of the SLM's 70 and 72 is integrated by means of a lens (not shown) and a spatial light filter 74 in order to obtain the $il^{th}$ element of the intermediate result U G. That $il^{th}$ element, shown in dashed lines within the spatial light filter 74, acts as the input to the next one-dimensional SLM 76. This next one-dimensional SLM 76 contains the $l^{th}$ row of the matrix V. Finally, a one-dimensional time-integrating detector array 78 is disposed after the SLM 76. As the columns of G and the corresponding rows of V are input synchronously to the first and third one-dimensional SLM's 70 and 76 respectively, the one-dimensional time-integrating detector array 78 accumulates the $i^{th}$ row of a. This $i^{th}$ row of a is read out after N cycles of the one-dimensional SLM's 70 and 76. The focusing lenses to be used between the different SLM's and the detector array are not shown for purposes of clarity in the drawing. However, such lense configurations to perform those focusing functions are well known in the art and would take approximately the same form as the lense configurations shown in FIGS. 2–5.

Figure 7:
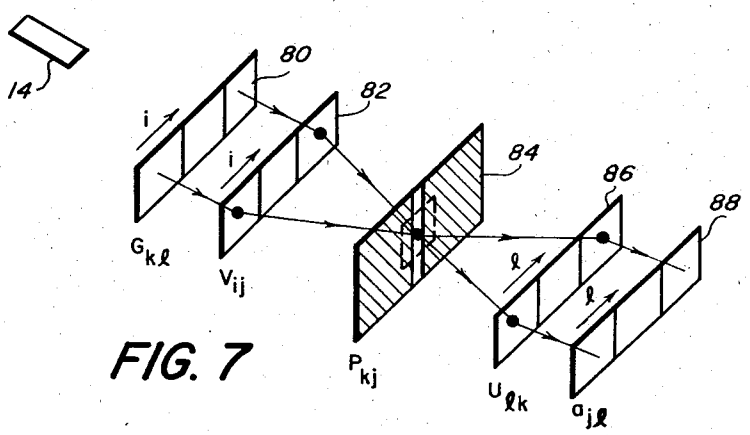
FIG. 7 is a schematic diagram of a fourth embodiment of the present invention for calculating a column of the triple-matrix-product-matrix.

If is desired to generate the $j^{th}$ column of a using the arrangement of FIG. 6, then the data input to the one-dimensional SLM's is changed. Such a configuration is shown in FIG. 7. In this configuration, the first one-dimensional SLM again is disposed horizontally for sequentially producing the rows of N×M matrix G wherein at a given instant the $k^{th}$ row G is reproduced thereon. Likewise, the second one-dimensional SLM contains the $j^{th}$ column of the matrix V. Again, this one-dimensional SLM 82 is parallel with the first SLM 80. The light from this second SLM 82 is then integrated by means of a lens (not shown) and a spatial light filter 84. The result of the light from the light source 14 propagating through the first and second SLM's 80 and 82 and being integrated is the $kj^{th}$ element of the intermediate result G V. This intermediate element is then immediately applied to the last one-dimensional SLM 86 which contains the $k^{th}$ column of the matrix U. A one-dimensional time-integrating detector array 88 is disposed in parallel with the SLM 86, respectively, in order to sum the outputs therefrom. After all of the N rows of G and the N columns of U are synchronously input to the first and third one-dimensional SLM's 80 and 86, respectively, then the $J^{th}$ column of a is obtained on the one-dimensional time-integrating detector array 88.

As noted previously, if only a few elements of a row or a column of a are desired, then time-integrating detectors can be placed only at those corresponding locations. However, the final answer is again available only after N cycles of the one-dimensional SLM's, regardless of how many elements of a are desired. It should be noted that since the configurations shown in FIG. 6 and 7 use only one-dimensional SLM's to input the matrices U, V, and G. These configurations have much better speed and dynamic range performance. Thus, the configurations shown in FIGS. 6 and 7 are clearly preferred when only rows or columns of the triple matrix product a are desired.

From the above, it can be seen that a significant advantage to the present design is that there is no requirement for storing the intermediate result in a triple matrix multiplication, as is necessary when a two-matrix multiplier is used for consecutive operations. An additional maJor advantage is that time-integrating detectors can be used. Such detectors can be made with greater dynamic range than a corresponding detector of the same type having high speed response characteristics.

Yet another advantage to the present design is that the two-dimensional SLM must only be updated after N cycles of the one-dimensional SLM's. Thus, the frame rates for this processor are not limited by the slow frame rates of present day two-dimensional SLM's.

The choice of which one-dimensional SLM device technology to use will be governed by the architecture, as well as by the format in which the data is available. When input matrices are available serially, then an acousto-optic Bragg cell with large time-bandwidth product (up to 2000) can be advantageously used to perform serial-to-parallel conversion while inputing the data. Note however that these acousto-optic Bragg cells have no memory, and thus cannot be used where the data is to remain constant for N cycles of the one dimensional SLM's in the system. (For example, see SLM 72 in FIG. 6). Where a one-dimensional SLM with memory is required, a one dimensional electro-optic SLM may be desired. Such electro-optic SLM's are also amenable to parallel addressing resulting in faster cycle times.

The two dimensional SLM may be optically or electrically addressed and can be chosen to fit the form in which the input data is available. The relatively slow rates (less than 100 frames per second) of present day two-dimensional SLM's is not a disadvantage in the above architectures, since the data contained thereon are updated at only 1/N the rate for the one-dimensional SLM's. The improved dynamic range of the time-integrating detectors over high bandwidth detectors (by the ratio of the square root of the respective readout rates) is another factor that enters into the choice of a suitable architecture for a given problem.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A triple matrix product processor for optically multiplying three matrices U, G, and V, comprising:

a matrix-vector processor for sequentially multiplying each column of a M×N matrix G by at least a portion of P×M matrix U, wherein at a given instant the $l^{th}$ column of G is multiplied by the at least a portion of matrix U producing at least the $il^{th}$ element of an intermediate result;

an outer product processor for multiplying said at least the $il^{th}$ element of said intermediate result with the $l^{th}$ row of an N×Q matrix V producing at least a portion of a P×Q outer product matrix in a first plane; and a time-integrating optical detector array for summing the light impinging on said first plane from said outer product processor to produce all or a desired portion of a P×Q triple matrix product after all of the N columns of said matrix G and all of the N rows of said matrix V have been cycled through said processors.

2. A triple matrix product processor as defined in claim 1, wherein said matrix-vector processor comprises:

a first 1×M one-dimensional spatial light modulator (SLM) disposed along one direction, e.g., horizontally, for sequentially producing the columns 1 to N of the M×N matrix G thereon, wherein at a given instant the $l^{th}$ column is reproduced thereon;

means for illuminating said first SLM;

a second spatial light modulator (SLM) for producing at least a row of the P×M matrix U thereon with the P rows in the horizontal direction and the M columns in the vertical direction;

first focusing means for focusing light from said first SLM to impinge on said second SLM;

second focusing means for focusing light from said second SLM to a second focusing plane; and a spatial light filter disposed in said second focusing plane for averaging the light from said second SLM;

and wherein said output product processor comprises a third one-dimensional spatial light modulator (SLM) disposed parallel to said first SLM, e.g. horizontally, for sequentially producing, in sequence with said first SLM, the rows 1 to N of the N×Q matrix V, wherein at said given instant the $l^{th}$ row is reproduced thereon;

third focusing means for focusing the averaged light from said spatial light filter on to said third SLM and fourth focusing means for focusing light from said third SLM on to said optical detector array.

3. A triple matrix product processor as defined in claim 2, wherein said second SLM comprises a two-dimensional P×M SLM for producing said P×M matrix U thereon.

4. A triple matrix product processor as defined in claim 3, wherein said first focusing means includes means for taking the Fourier transform of the light in the vertical direction and imaging the light in the horizontal direction from said first SLM onto said second SLM;

wherein said second focusing means includes means for taking the Fourier transform of the light from said second SLM in the horizontal direction and imaging the light in the vertical direction; and wherein said third focusing means includes means for taking the two-dimensional Fourier transform of the light from said spatial light filter.

5. A triple matrix product processor as defined in claim 3, wherein said optical detector array comprises a P×Q detector array for detecting the entire P×Q triple matrix product.

6. A triple matrix product processor as defined in claim 5, wherein said fourth focusing means includes means for taking the Fourier transform of the light from said third SLM in the vertical direction while imaging the light from said third SLM in the horizontal direction so that both directions are imaged in the plane of said optical detector array.

7. A triple matrix product processor as defined in claim 4, wherein said optical detector array comprises at least one element for detecting at least one element of the P×Q triple matrix product.

8. A triple matrix product processor as defined in claim 3, wherein said second SLM is a one-dimensional SLM for producing $i^{th}$ row in the horizontal direction of said P×M matrix U thereon; and wherein said optical detector array comprises a one-dimensional optical detector array for accumulating the $i^{th}$ row of said P×Q triple matrix product.

9. A triple matrix product processor as defined in claim 2, wherein said matrix-vector processor comprises:

a first spatial light modulator (SLM) for producing at least one row of the P×M matrix U thereon, with the P rows in the horizontal direction and the M columns in the vertical direction;

means for illuminating said first SLM;

a second 1×M one-dimensional spatial light modulator (SLM) disposed along one direction, e.g., horizontally, for sequentially producing the columns 1 to N of said M×N matrix G thereon, wherein at a given instant the $l^{th}$ column is reproduced thereon;

first focusing means for focusing light from said first SLM to impinge on said second SLM;

second focusing means for focusing light from said second SLM to a second focusing plane; and a spatial light filter disposed in said second focusing plane for averaging the light from said second SLM; and wherein said outer product processor comprises a third one-dimensional spatial light modulator (SLM) disposed parallel to said first SLM, e.g., horizontally, for sequentially producing, in sequence with said first SLM, the rows 1 to N of said N×Q matrix V, wherein at said given instant the $l^{th}$ row is reproduced thereon;

third focusing means for focusing the averaged light from said spatial light filter on to said third SLM; and fourth focusing means for focusing light from said third SLM on to said optical detector array.

10. A triple matrix product processor as defined in claim 9, wherein said first SLM comprises a two-dimensional P×M SLM for producing said P×M matrix U thereon.

11. A triple matrix product processor a defined in claim 10, wherein said first focusing means includes means for imaging the light from said first SLM in the horizontal direction and taking the Fourier transform of the light from said first SLM in the vertical direction;

wherein said second focusing means includes means for taking the two-dimensional Fourier transform of the light from said second SLM; and wherein said third focusing means includes means for taking the two dimensional Fourier transform of the light from said spatial light film.

12. A triple matrix product processor as defined in claim 11, wherein said optical detector array comprises a P×Q detector array for detecting the entire P×Q triple matrix product.

13. A triple matrix product processor as defined in claim 12, wherein said fourth focusing means includes means for taking the Fourier transform of the light from said third SLM in the vertical direction while imaging the light from said third SLM in the horizontal direction so that both directions are imaged in the plane of said optical detector array.

14. A triple matrix processor as defined in claim 9, wherein said first SLM is a one-dimensional SLM for producing the $i^{th}$ row in the horizontal direction of said P×M matrix U thereon, and wherein said optical detector array comprises a one-dimensional optical detector array for accumulating the $i^{th}$ row of said P×Q triple matrix product.

15. A triple matrix product processor for optically multiplying three matrices U, G, and V, comprising:

a matrix vector processor for sequentially multiplying each row of an N×M matrix G, e.g. the $k^{th}$ row G, by at least the $j^{th}$ column of the matrix V and producing the $kj^{th}$ element of an intermediate result G·V;

an outer product processor for multiplying said $kj^{th}$ element of the intermediate result with the $k^{th}$ column of the QxN matrix U producing at least the $j^{th}$ column of an P×Q outer product matrix in a first plane; and a time-integrating optical detector array for summing the light impinging on said first plane from said outer product processor to produce at least a part of the $j^{th}$ column of said P×Q triple matrix column after all of the N rows of said matrix G and all of the N columns of matrix U have been cycled through said processors.

16. A triple matrix product processor as defined in claim 15, wherein said matrix-vector processor comprises:

a first 1×M one-dimensional spatial light modulator (SLM) disposed along one direction, e.g., horizontally, for sequentially producing the rows 1 to N of the N×M matrix G thereon, wherein at a given instant the $k^{th}$ row of G is reproduced thereon;

means for illuminating said first SLM;

a second spatial light modulator (SLM) for producing at least the $j^{th}$ column of the matrix V thereon parallel to said first SLM, e.g., horizontally;

a spatial light filter disposed in a plane for averaging the light from said second SLM; and wherein said outer product processor comprises a third one-dimensional spatial light modulator (SLM) disposed parallel to said first SLM, e.g. horizontally, for sequentially producing, in sequence with said first SLM, the columns 1 to N of the Q×N matrix U, wherein at said given instant the $k^{th}$ column of U is reproduced thereon.

17. A triple matrix product processor as defined in claim 16, wherein said second SLM produces only the $j^{th}$ column of the matrix V, and wherein said optical detector array comprises a one-dimensional optical detector array for accumulating the $j^{th}$ column of said P×Q triple matrix product.

18. A method for optically multiplying three matrices U, G, and V, comprising the steps of:

sequentially optically multiplying each column of a M×N matrix G by at least a row of a P×M matrix U, wherein at a given instant the $l^{th}$ column of G is multiplied by the matrix U producing at least the $il^{th}$ element of an intermediate result;

performing an outer product process by optically multiplying at least $il^{th}$ element of said intermediate result with the $l^{th}$ row of a N×Q matrix V producing light representing at least a row of an P×Q outer product matrix in a plane; and time-integrating the light impinging on said plane from said outer product process step to produce all or a desired portion of the P×Q triple matrix product after all of the N columns of said matrix G and all of the N rows of said matrix V have been multiplied.

19. A method as defined in claim 18, wherein said sequentially multiplying step includes the steps of:

first, sequentially modulating light in accordance with the columns of said matrix G in one direction, e.g. horizontally, in a first one-dimensional spatial array in a first plane, wherein at a given instant the $l^{th}$ column is modulated in said first spatial array;

second, modulating said $l^{th}$ column light of matrix G from said first spatial array in a second plane by at least a row of the P×M matrix U, with the rows in the horizontal direction and the columns in the vertical direction;

spatially filtering the modulated light from said second modulating step to obtain the $l^{th}$ column of said intermediate result; and wherein said outer product performing step comprises the step of third, sequentially modulating said intermediate results with the rows of the N×Q matrix V in a third one-dimensional spatial array disposed parallal to said first one-dimensional spatial array in a third plane, wherein the $l^{th}$ column of said intermediate result is modulated by the $l^{th}$ row of said matrix V.

20. A method as defined in claim 19, wherein said second modulating step comprises the step of modulating the $l^{th}$ column of matrix G by the full P×M matrix U simultaneously in a second spatial array in said second plane.

21. A method as defined in claim 20, wherein said second modulating step comprises the step of focusing the light from said first modulating step by taking the Fourier transform of the light in the vertical direction and imaging the light in the horizontal direction onto said second spatial array;

wherein said spatial filtering step comprises the step of focusing the light modulated in said second spatial array by taking the Fourier transform of the light in the horizontal direction and imaging the light in the vertical direction; and wherein said third modulating step comprises the step of focusing the light from said spatial filtering step onto said third spatial array by taking the two-dimensional Fourier transform of the light.

22. A method as defined in claim 21, wherein said time-integrating step comprises the step of producing the entire P×Q triple matrix product onto a P×Q spatial array in a fourth plane; and the focusing step of focusing the light from said third modulating step by taking the Fourier transform of the light from said third modulating step in the vertical direction, while imaging this light in the horizontal direction so that both directions are imaged onto said P×Q spatial array in said fourth plane.

* * * * *